United States Patent [19]

Wong

[11] Patent Number: 4,614,671

[45] Date of Patent: Sep. 30, 1986

[54] ARTIFICIAL LEATHER WITH NON-WOVEN OR FLUFFY CLOTH BASE AND FOAMED PVC FILLER

[76] Inventor: Winston W. Wong, 201, Tung Hwa N. Rd, Taipei, Taiwan

[21] Appl. No.: 555,706

[22] Filed: Nov. 28, 1983

[51] Int. Cl.[4] ..... B05D 5/00

[52] U.S. Cl. ..... 427/245; 427/355; 428/904

[58] Field of Search ..... 428/904, 319.7, 319.3, 428/304.4; 427/245, 355

[56] References Cited

U.S. PATENT DOCUMENTS 4,349,597 9/1982 Fine et al. ..... 428/904

FOREIGN PATENT DOCUMENTS 1168778 10/1969 United Kingdom ..... 428/317.5

*Primary Examiner*—James J. Bell

*Attorney, Agent, or Firm*—Bucknam and Archer

[57] ABSTRACT

Artificial leather having a novel structure comprises a non-woven cloth mat or fluffy cloth as the base, while the structure is filled with foamed PVC. The product thus formed is of excellent physical property, resilience and hand feeling.

1 Claim, 4 Drawing Figures

ARTIFICIAL LEATHER WITH NON-WOVEN OR FLUFFY CLOTH BASE AND FOAMED PVC FILLER

The present invention relates to artificial leather and more particularly to an artificial leather with non-woven mat or fluffy cloth base and foamed PVC filler. In other words, the product is a laminate of non-woven or fluffy cloth and a structure of foamed PVC.

Existing non-woven cloth in the market is usually a non-woven mat impregnated with paste of NBR or SBR. The cost is quite high. Artificial leather with such cloth as base is made by adhering PVC or PU thereto, but both hand feeling and physical properties are not good. The reasons are: so far as the non-woven cloth is concerned, (i) The non-woven mat is merely a fiber filled material, with insufficient strength, too easily to be deformed under stretching.

(ii) The impregnated with NBR or SBR fails not only to give resilient feel and porosity but also causes a phenomenon of so called "orange skin effect", so that the value of the product is degraded;

(iii) Consumers reject the product because of its uncompetitive property and high price.

Hence the artificial leather there-produced inherits the undesirable quality and becomes, (i) either too stiff or too soft, hand feeling is poor;

(ii) lack of good appearance;

(iii) general deficiency in property is the cause of poor durability and liable to damage after use.

In view of such draw-backs of the conventional non-woven cloth and the structure of artificial leather so made, a novel artificial leather with improved structure results from the diligent study of the present inventor.

Therefore, the main object of the present invention is to provide a laminate of PVC foamed structure with non-woven mat or fluffy cloth, to improve the physical properties and hand feeling of the finished artificial leather which is suitable for many uses.

Another object of the present invention is to provide an artificial leather of light weight per unit which is required in the manufacture of sport shoes and luggage.

A further object of the present invention is to provide an artificial leather with a laminate structure of non-woven mat or fluffy cloth base with foamed PVC filler, the base material therein is of non-direction or random orientation to facilitate sampling and cutting with the least waste possible.

Still another object of the present invention is to provide a base material when PVC sheet or PU is to be applied or coated thereon, the adhesion can be directly effected without further pasting procedure to achieve better appearance.

A still further object of the present invention is to provide a novel artificial leather with non-woven mat or fluffy cloth base and foamed PVC filler, that is of low cost and easy to be manufactured in mass production.

In conjunction with the annexed drawings, the present invention is described by way of examples and embodiments in more details, where:

Figure 1:
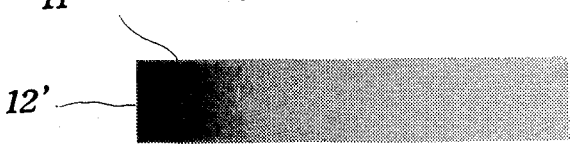
FIG. 1 is a schematic diagram of the structure of non-woven material of the prior art which is a non-woven mat (11') impregnated with rubber paste agent (12').
Figure 2:
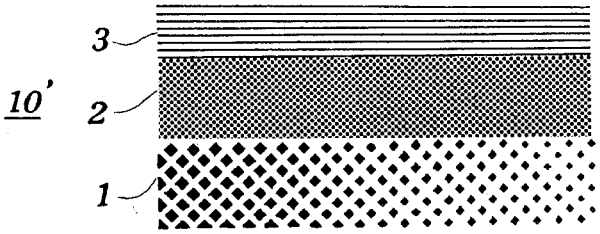
FIG. 2 is a schematic diagram of a structure of conventional artificial leather (10') composed of from top to bottom the successive layers of a PVC sheet (3), a foamed PVC layer (2) and a base cloth (1)
Figure 3:
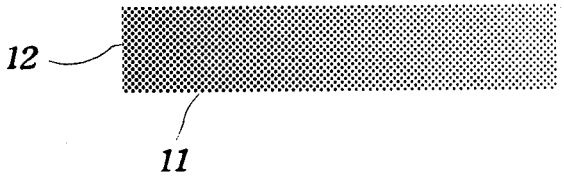
Figure 4:
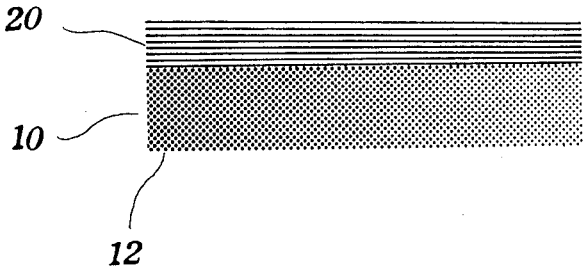

FIG. 3 illustrates the structure of an embodiment of the artificial leather of the present invention, wherein PVC resin or foamed PVC (12) is filled to form non-woven mat or fluffy cloth (11) based artificial leather (10); and FIG. 4 shows another embodiment of the artificial leather of the present invention which is formed with PVC sheet or PU (20) adhered to a non-woven cloth or fluffy sheet (10) which is filled with PVC resin or foamed PVC (12).

A formulation of the impregnating plastic paste, foamable or non-foamable, is as follows:

| Ingredient | Parts by weight |
|---|---|
| PVC emulsion Powder | 100 |
| plasticizer | 30–140 |
| filler, $CaCO_3$ | 0–100 |
| foaming agent | 0–4 |
| stabilizer | 2–5 |
| diluent, white alcohol | 5–30 |
| pigment | 0–10 |

Now the manufacturing Processes are described stepwise:

(A) Preparation of non-woven mat:

1. Staples of synthetic fiber are beaten and mixed;
2. comb or needle comb;
3. net setting first laterally then longitudinally by needle;

mat material thus formed is of non-direction or random oriented.

(B) Manufacture of artificial leather:

Product I

1. Impregnate the mat material prepared from (A) in foamable PVC plastic paste in a paste impregnating machine;
2. foam in a foaming machine;
3. slice into two sheets in a slicer;
4. roll.

Product II

1. Impregnate mat material of (A) in foamable PVC plastic paste in a paste impregnating machine;
2. draw from sheet machine non-foamable facing sheet and adhere to the paste impregnated mat;
3. print the surface in a printer,
4. foam and emboss in a foaming machine,
5. surface treatment in a treating machine;
6. grind the back in a grinder;
7. roll the product.

Product III

1. Impregnate the mat material of (A) in foamable PVC plastic paste in a paste impregnating machine;
2. foam in a foaming machine;
3. grind both surfaces in a grinder;
4. separately coat PU on a releasing paper in a coating machine, dry;
5. coat dual liquid type PU adhering agent in the coating machine;
6. adhere to the intermediate product from step 3 and dry on the coating machine;
7. curing or aging
8. release the paper on a releasing machine;
9. treat the surfaces in a treating machine;

10. roll.

EXAMPLES

First beat and mix the synthetic fiber staples then feed into a combing machine, set the fibers into lateral netting then into longitudinal netting by needle to foam non-woven mat.

EMBODIMENT I

Dip the non-woven mat of 2.0 m/m thickness in a paste impregnating machine, into 35 PHR foamable plastic paste, squeeze dry and press flat to form a mat of 2.3 m/m thick, containing 2.2 Kg/Yd.-38" plastic paste. Dry in a heating furnace of 10 m in length under 3 Yd./min. linear velocity, foam under 240° C. in a foaming machine, press to form a semi-finished product of 4.0 m/m thick, slice into two 2.0 m/m thick pieces. The final product is suitable for making shoe sole and luggage skeleton.

EMBODIMENT II

Dip non-woven mat of 1.5 m/m thickness in a paste impregnating machine, into 80–140 PHR foamable plastic paste, squeeze dry and press flat to form a mat of 2.0 m/m thick, containing 1.1 Kg/Yd.-38" plastic paste. Dry in heating furnace of 10 m in length, under 160° C. with a linear velocity of 3 Yd./min. Adhere in a sheet machine, under 175° C., to a PVC sheet of 0.25 m/m thickness drawn therefrom. Print the surface in a printer, foam under 220° C. in a foaming machine, emboss to form a semi-finished product of 3.0 m/m thick, treat the surfaces in a treating machine, grind the bottom surface with 120 mesh sand paper to acquire a thickness of 2.5 m/m. Inspect the product in an inspecting machine, cut to 20 Yd. length, roll and pack.

EMBODIMENT III

Dip the non-woven mat of 0.9 m/m thickness in a paste soaking machine, into a 80–140 PHR foamable plastic paste, squeeze dry and press flat to form a mat of 1.8 m/m thick, containing 1.2 Kg/Yd.-38" plastic paste. Dry in a heating furnace of 10 m in length, under 160° C. with a linear velocity of 3 Yd./min. Grind both surfaces with 120 mesh sand paper in a grinder to serve an intermediate product. Separately, in a coating machine coat PU resin on a releasing paper, dry under 130° C., apply a further coating of dual liquid type PU adherent, to promote the adhesion between PVC and PU surfaces. Adhere the ground intermediate product to PU coated paper, dry under 140° C., roll and deliver to curing or aging room, under 50° C. for 48 hours, tear away the releasing paper, treat the surface in a treating machine to improve the hand feel and brightness. Inspect, cut to 20 Yd. lengths, roll and pack.

In these embodiments the impregnated base mat is squeezed and pressed flat to retain 0.5–2.5 Kg/Yd.-38" of plastic paste and then dried at 140°–180° C. prior to further processing.

I claim:

1. The method of manufacturing an artificial leather which consists of preparing a base mat, impregnating the base mat with a paste of a first polymeric resin material which is a foamable PVC resin, to form a filled base mat, coating the filler base mat with a second polymeric resin material, wherein the filler base mat is squeezed and pressed flat to retain 0.50–2.5 Kg/Yd-38" of said paste, then dried at 140°–180° C., foamed and sliced to the desired thickness.

* * * * *